United States Patent [19]

Cole

[11] 4,051,330

[45] Sept. 27, 1977

[54] HEARING AID HAVING ADJUSTABLE DIRECTIVITY

[75] Inventor: William A. Cole, Brantford, Canada

[73] Assignee: Unitron Industries Ltd., Kitchener, Canada

[21] Appl. No.: 687,434

[22] Filed: May 17, 1976

[30] Foreign Application Priority Data

June 23, 1975 Canada ..... 229948

[51] Int. Cl.[2] ..... H04R 1/38; H04R 25/00

[52] U.S. Cl. ..... 179/107 FD

[58] Field of Search ..... 179/1 DM, 121 P, 107 FD, 179/178, 179, 180

[56] References Cited

U.S. PATENT DOCUMENTS

| | | | |
|---|---|---|---|
| 3,257,516 | 6/1966 | Knowles | 179/180 |
| 3,836,732 | 9/1974 | Johanson et al. | 179/107 FD |
| 3,909,556 | 9/1975 | Johanson | 179/107 FD |

FOREIGN PATENT DOCUMENTS

| | | | |
|---|---|---|---|
| 190,988 | 7/1957 | Austria | 179/121 D |

*Primary Examiner*—George G. Stellar

*Attorney, Agent, or Firm*—Rogers, Bereskin & Parr

[57] ABSTRACT

A hearing aid having a two port microphone for adjustable directivity. The microphone front port is connected to a front port in the casing by a soft resilient rubber tube. The microphone rear port is connected by another soft resilient rubber tube to an outlet in the top of the casing, which outlet is covered by a slider. The slider has a channel communicating with the outlet and having front and rear openings separated by a divider wall. Depending on the position of the slider, the outlet connects with either the front or rear channel opening, controlling the directivity of the aid. The microphone is supported by the rubber tubes, which isolate it from the remainder of the aid.

3 Claims, 6 Drawing Figures

HEARING AID HAVING ADJUSTABLE DIRECTIVITY

This invention relates to a hearing aid having adjustable directivity.

Directional hearing aids have been on the market for some time. These are hearing aids in which the microphone is provided with at least two physically separated sound inlet ports. Sound originating from a specific source reaches the inlet ports at different times, and the resultant cancellation or reinforcement of the sound waves provides the wearer of the hearing aid with an indication of the direction or location of the sound source.

Since the hearing characteristics of hearing aid users differ, it is important that the directivity characteristics of the hearing aid be adjustable. This allows tailoring of the hearing aid characteristics to the disabilities of the individual user. Unfortunately, prior devices of which the applicant is aware for adjusting the directivity have serious disadvantages.

A prior hearing aid having adjustable directivity is shown in U.S. Pat. No. 3,770,911. This patent shows a hearing aid in which the microphone is mounted in a cavity having front and rear ports, and various arrangements are shown for blocking the entrance to one of the ports, or for adjusting the communication between the ports. A major disadvantage of the system shown in this patent is that the microphone must be mounted in a relatively large cavity. It has been found that the space requirements of the cavity are such that the hearing aid cannot be miniaturized to a suitable degree. In addition blocking one of the ports tends to boost the low frequency response of the hearing aid, which is extremely undesirable. Further, removal and replacement of the microphone for repair is not particularly convenient, and vibrational isolation of the microphone is not optimized.

Accordingly, it is an object of the present invention to provide a hearing aid having adjustable directivity, in which the microphone need not be mounted in a specially prepared large acoustic cavity, and in which very simple means are provided for adjusting the directivity of the hearing aid without blocking either of the microphone ports. To this end the invention provides in its broadest aspect, in a hearing aid comprising:

1. a casing,
2. a microphone having first and second spaced sound ports, the improvement comprising:
3. means defining a third port in said casing,
4. means communicating said third port to said first port,
5. means defining fourth and fifth ports, said fourth port being located adjacent said third port and said fifth port being spaced substantially from said third port,
6. means communicating said fourth and fifth ports to said second port,
7. a movable member having sound barrier means thereon,
8. means mounting said movable member for movement between a first position in which said sound barrier means blocks communication between said second port and said fourth port while permitting communication between said second port and said fifth port, and a second position in which said sound barrier means blocks communication between said second port and said fourth port while permitting communication between said second port and said fifth port.

Further objects and advantages of the invention will appear from the following description, taken together with the accompanying drawings, in which.

Figure 1:
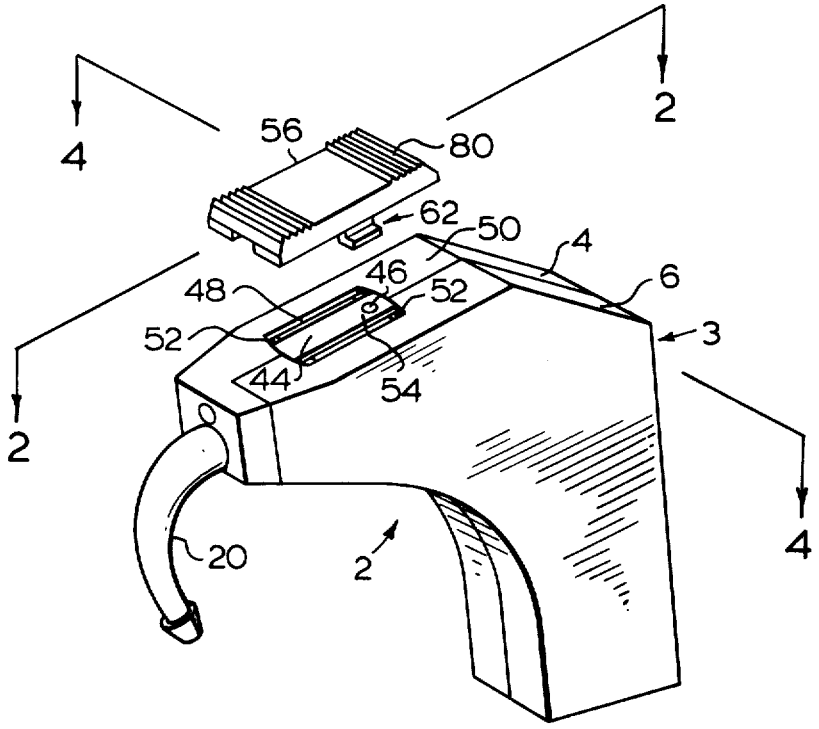
FIG. 1 is a perspective partly exploded view of a hearing aid according to the invention.
Figure 2:
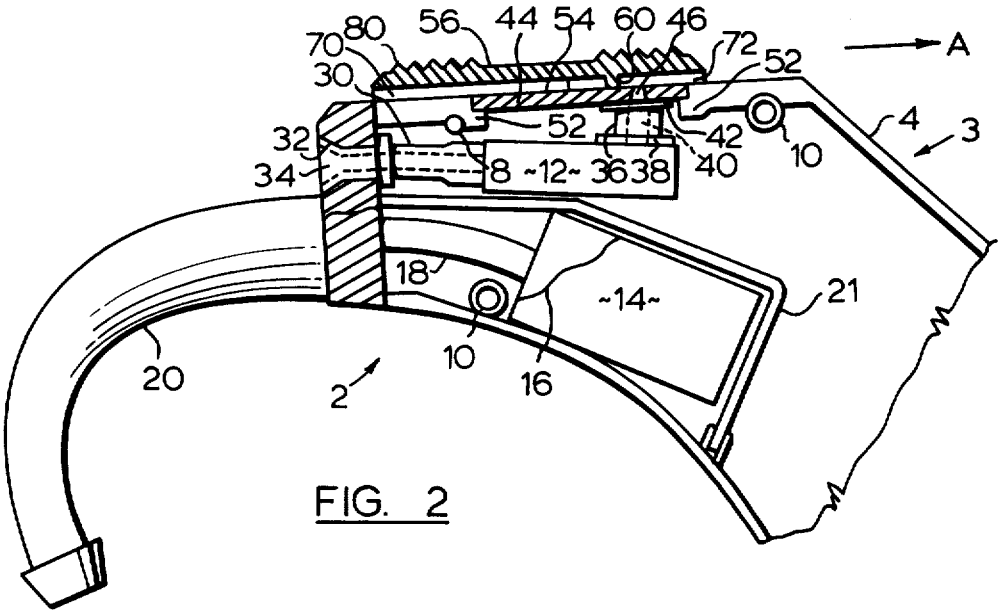
FIG. 2 is a sectional view taken along lines 2—2 of FIG. 1.

Reference is first made to FIGS. 1 and 2, which show a hearing aid generally indicated at 2. The hearing aid 2 includes a casing 3 which consists of a main casing section 4, and a laterally removable casing side section 6 which snaps into position on the casing section 4 by interfitting plastic pins and hollow dowels, several of which are indicated at 8, 10 in FIG. 2. Removal of the side section 6 exposes the inside of the hearing aid for service or repair.

Located within the hearing aid causing is a microphone 12 and an output transducer 14 (FIG. 2). The output transducer 14 is mounted within a rubber cover 16, to reduce vibration transferred to the remainder of the hearing aid, and is connected by a plastic tube 18 to a standard curved plastic ear tube 20 which extends into the user's ear. The transducer 14 is supported from the remainder of the hearing aid by a wall 21, typically of metal.

Figure 3:
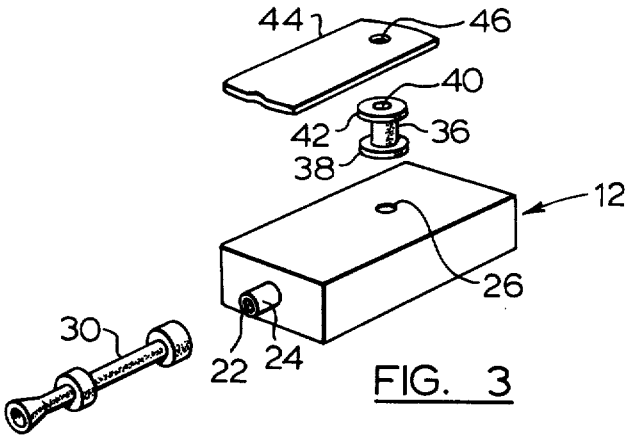
FIG. 3 is a perspective exploded view showing the microphone of the FIG. 1 hearing aid and also showing sound tubes and a mounting plate for attachment thereto.

The microphone 12 is typically a pressure gradient microphone, and may be model No. BT1784 manufactured by Knowles Electronics of Chicago, Ill. The microphone 12 includes a front port 22 (FIG. 3), defined by a nipple 24 on the microphone capsule, and a rear port or opening 26.

The microphone 12 is mounted in the hearing aid 2 as follows. A front rubber tube 30, of soft (i.e., very low stiffness flexible, resilient rubber, e.g. "Neoprene" (trade mark), plugs over the nipple 24 and extends into a front sound port 32 located in the front of the casing, over the ear tube 20. The rubber tube 30 performs two functions, firstly to support the front of the microphone 12, and secondly to conduct sound from the front port 32 in the casing to the front port 22 of the microphone. The opening 34 in the front of tube 32 becomes the effective front port for the microphone.

The rear of the microphone 12 is supported by a second tube 36 (FIGS. 2, 3) also made of highly flexible and resilient soft rubber. The tube 36 includes a lower flange 38 which is glued to the upper surface of the microphone so that the aperture 40 of the tube 36 is in registry with the rear port 26 of the microphone. The tube 36 also includes an upper flange 42 which is glued to a thin generally rectangular plastic support plate 44. The support plate 44 includes an aperture 46 therein in registry with the aperture 40 of the second tube 36. When the support plate 44 is mounted in the casing, as will be described shortly, the second tube 36 serves to support the rear of the microphone 12 and also to conduct sound to the rear port 26 of the microphone.

The support plate 44 for the microphone is mounted in the casing 3 as follows. As shown in FIGS. 1 and 2, the casing 3 includes an upper generally rectangular opening 48 in its upper surface 50. The opening 48 is of the same length as the support plate 44 (plus a slight clearance) and is slightly wider than the support plate 44, for a purpose to be described. The opening 48 includes, at its front and rear, laterally extending lower lips 52, which constitute supports for the support plate 44. The spacing of the lips 52 below the upper surface of the casing is equal to the thickness of the support plate 44, so that the support plate 44 may be positioned in the opening 48 with the upper surface 54 of the support plate 44 flush with the upper surface 50 of the casing 3.

The direction from which sound is allowed to enter the rear port 26 of the microphone is controlled by a slider plate or slider 56, best shown in FIGS, 2, 4 and 5. The slider 56 is generally rectangular in shape and includes a central longitudinal channel 58 in its lower surface 59. The channel 58 extends the entire length of the slider 56 but is bisected by a divider wall 60 which extends at an angle across the channel 58 and fully blocks the channel. The slider 56 is provided with a pair of short L-shaped legs 62, each consisting of a downwardly projecting section 64 and an outwardly extending lip 66.

Figure 4:
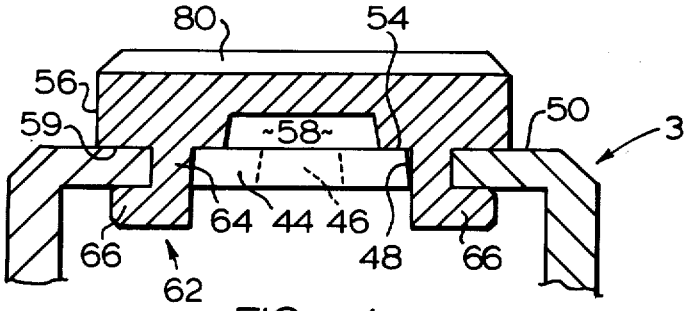
FIG. 4 is a sectional view taken along lines 4—4 of FIG. 1.
Figure 5:
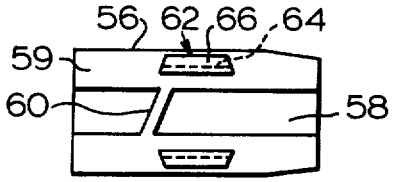
FIG. 5 is a bottom view of a slider plate of the FIG. 1 hearing aid.

As best shown in FIG. 4, the slider 56 is mounted on the hearing aid with the downwardly extending sections 64 of the legs 62 fitted into the gaps between the support plate 44 and the sides of the opening 48 in the top of the hearing aid casing. The lips 66 of the legs extend beneath the casing 3 to retain the slider 56 in position and to permit it to be slid back and forth, from the front to the back of the opening 48.

When the slider 56 is in position, its lower surface 59 contacts the upper surface 50 of the casing 3 and also contacts and fully covers the upper surface of the support plate 44, except for a central longitudinal strip of the support plate which is exposed by the channel 58. This exposes the sound port 46 in the support plate 44 to the channel 58 in the slider. Thus either the front or rear opening of the channel 58 (these openings are indicated at 70, 72 in FIG. 2) becomes the effective rear port for the microphone 12, depending on the position of the slider 56.

FIG. 2 shows the slider 56 as being slid to its most forward position. In this position the rear port 26 of the microphone communicates with the rear channel opening 72, which now becomes the effective rear port for the microphone. Access from the rear microphone port 26 to the front opening 70 of the channel 58 is blocked by the divider wall 60. When the slider 56 is slid in the direction of arrow A, FIG. 2, the divider wall 60 moves to the position shown in FIG. 2A and blocks communication between the microphone port 26 and the rear channel opening 72, while permitting communication between the microphone rear port 26 and the front channel opening 70. The opening 70 now becomes the effective rear port for the microphone.

Figure 2A:
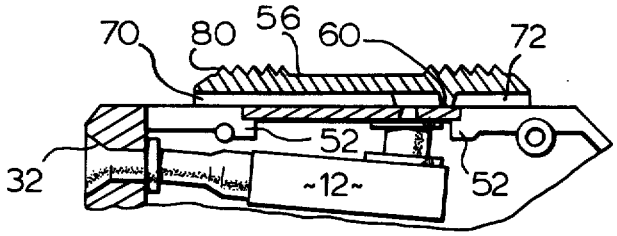
FIG. 2A is a view similar to that of FIG. 2 but showing a slider in a different position.

When the slider 56 is in the position shown in FIG. 2A, the effective port spacing between the ports of the microphone becomes the straight line distance between openings 70, 32. This distance is chosen such that the microphone is essentially non-directional (it will be seen that openings are adjacent). When the slider 56 is in the position shown in FIG. 2, the effective port spacing is the straight line distance between openings 32, 72. With this substantial spacing, sound travelling from front to rear reaches the effective front port 32 at a time different from that at which sound reaches the effective rear port 72, and the same is true for sound travelling from rear to front. The microphone is therefore directional. Intermediate positions of the slider 56, so that the divider wall allows some communication from both the front and rear channel openings 70, 72 to the microphone rear port 26, produces mixing of signals from openings 70, 72 and yields intermediate degrees of directionality. The angling of the divider wall 60 across the channel 58 permits more accurate control of the degree of directivity achieved.

To facilitate movement of the slider 56 by a user, the upper surface of the slider is molded with raised ribs 80 which can be gripped by a user's finger.

To assemble (or disassemble) the hearing aid, the side section 6 of the casing is removed. The microphone 12, and tubes 30, 36 may then be placed in position and the support plate 44 may be placed in the opening 48 as shown in FIG. 1. One leg of the slider 56 is inserted in the space between the support plate 44 and the side of the opening 48, thus positioning the slider. The removable casing section 6 is then applied, sandwiching the slider legs 62 and the support plate 44 in position in the opening 48 and preventing removal of the slider. The flexibility of the second tube 36 permits movement and insertion of the support plate 44 with the microphone in position in the hearing aid.

In the preferred embodiment described, since the microphone 12 is supported solely by the soft tubes 30, 36, good vibrational isolation is provided between the microphone and the remainder of the hearing aid. At the same time the microphone can very easily be removed from the hearing aid, simply by disconnecting its leads (not shown) from the remainder of the circuit (not shown) and then removing the entire microphone, the tubes 30, 36, and the support plate 44. The front tube 30 pulls easily from the front port 32 of the casing. The front tube 30 can easily be removed from the nipple 22 when required, and the glued tube 36 can easily be stripped away from the microphone 12 or reglued as required.

What I claim is:

1. In a hearing aid comprising:

1. a casing,
2. a microphone having first and second spaced sound ports, the improvement comprising:

3. means defining a third port in said casing,
4. means communicating said third port to said first port,
5. means defining fourth and fifth ports, said fourth port being located adjacent said third ports and said fifth port being spaced substantially from said third port,
6. means communicating said fourth and fifth ports to said second port,
7. a movable member having sound barrier means thereon,
8. means mounting said movable member for movement between a first position in which said sound barrier means blocks communication between said second port and said fourth port while permitting communication between said second port and said fifth port, and a second position in which said sound barrier means blocks communication between said second port and said fifth port while permitting communication between said second port and said fourth port, 9. said movable member being a slider plate having a longitudinal channel in the lower surface thereof, said means (8) including means mounting said slider plate for sliding movement on said casing, said channel having front and rear openings, said front opening being said fourth port and said rear opening being said fifth port, a divider wall located in said channel and constituting said sound barrier means, said means (8) including sound conduit means communicating said channel to said second port, 10. said means mounting said second tube on said casing comprising a thin rectangular support plate having an opening therein, means securing said second tube to said support plate with the opening in said support plate member aligned with the interior opening of said second tube, said casing having an upper substantially rectangular opening therein, said rectangular opening being of substantially the same length as said support plate and being of width slightly greater than that of said support plate, said casing having a pair of lips therein to support said support plate with the upper surface of said support plate flush with the upper surface of said casing, said slider plate having a pair of L-shaped legs extending through said opening in said casing and under said casing for said slider plate to slide in said opening in said casing with said channel aligned with the opening in said support plate.

2. In a hearing aid comprising:

1. a casing,
2. a microphone having first and second spaced sound ports, the improvement comprising:
3. means defining a third port in said casing
4. means communicating said third port to said first port,
5. means defining fourth and fifth ports, said fourth port being located adjacent said third port and said fifth port being spaced substantially from said third port,
6. means communicating said fourth and fifth ports to said second port,
7. a movable member having sound barrier means thereon,
8. means mounting said movable member for movement between a first position in which said sound barrier means blocks communication between said second port and said fourth port while permitting communication between said second port and said fifth port, and a second position in which said sound barrier means blocks communication between said second port and said fifth port while permitting communication between said second port and said fourth port,
9. said means communicating said third port to said first port including a first soft flexible tube connected between said casing and said microphone, and said means communicating said fourth and fifth ports to said second port including a second soft flexible tube connected to said microphone, and means supporting said second soft flexible tube on said casing, said microphone being supported by said tubes and said tubes thereby providing vibrational isolation between said microphone and said casing,
10. said movable member being a slider plate having a cover surface and a longitudinal channel in said lower surface, and means (8) including means mounting said slider plate for sliding movement on said casing with said lower surface contacting said casing, said channel having front and rear openings, said front opening being said fourth port and said rear opening being said fifth port, a divider wall located in said channel and constituting said sound barrier means, said second tube communicating with said channel,
11. said means mounting said second tube on said casing comprising a thin rectangular support plate having an opening therein, means securing said second tube to said support plate with the opening in said support plate member aligned with the interior opening of said second tube, said casing having an upper substantially rectangular opening therein, said rectangular opening being of substantially the same length as said support plate and being of width slightly greater than that of said support plate, said casing having a pair of lips therein to support said support plate with the upper surface of said support plate flush with the upper surface of said casing, said slider plate having a pair of L-shaped legs extending through said opening in said casing and under said casing for said slider plate to slide in said opening in said casing with said channel aligned with the opening in said support plate.

3. A hearing aid according to claim 2 wherein said casing includes a main casing section and a side casing section laterally removable from said main section, said upper rectangular opening being located partly in said main casing section and partly in said side section, whereby removal of said side section exposes said support plate and said slider plate for removal.

* * * * *